United States Patent [19]

Bellehumeur

[11] Patent Number: 4,591,125

[45] Date of Patent: May 27, 1986

[54] PICTURE HANGING DEVICE

[76] Inventor: Lucien J. Bellehumeur, 71 rue Principale, Apt. 8, Rouyn, Quebec J9X 4P3, Canada

[21] Appl. No.: 729,748

[22] Filed: May 2, 1985

[51] Int. Cl.[4] ..... A47G 1/24

[52] U.S. Cl. ..... 248/476; 248/480; 248/495

[58] Field of Search ..... 248/476, 477, 480, 489, 248/495, 496, 223.4, 224.2, 224.1, 224.3, 224.4, 225.1; 40/152.1, 10 R

[56] References Cited

U.S. PATENT DOCUMENTS

| | | | |
|---|---|---|---|
| 2,402,717 | 6/1946 | Winer . | |
| 2,965,339 | 12/1960 | Denton | 248/495 |
| 3,294,355 | 12/1966 | Topf | 248/489 X |
| 3,622,116 | 11/1971 | Fellows . | |
| 3,865,342 | 2/1975 | Kanzelberger . | |
| 3,928,894 | 12/1975 | Bury et al. | 248/223.4 |
| 4,069,998 | 1/1978 | Rytting . | |
| 4,083,525 | 4/1978 | Rath | 248/477 X |
| 4,437,639 | 3/1984 | Stein . | |
| 4,522,363 | 6/1985 | Stuart | 248/480 |

*Primary Examiner*—Ramon S. Britts
*Assistant Examiner*—Ramon O. Ramirez
*Attorney, Agent, or Firm*—Karen M. Gerken; Martin P. Hoffman

[57] ABSTRACT

A picture hanging device comprising a male member adapted to be rigidly secured to the back of a picture frame or other like object and a female member adapted to be rigidly secured to a wall or other vertical support surface. The male member includes an upper fastening flange and a resilient lower tongue normally lying in the same vertical plane. The fastening flange is provided with a fixed or movable spacing portion which protrudes beyond the fastening flange and the tongue. The female member comprises an upper guiding portion and a lower slot. The guiding portion guides the tongue into the slot and contacts the spacing portion when the tongue is fully inserted within the slot. A portion of the tongue remains exposed above the slot when fully inserted therein such that the exposed portion is deflected outwardly so as to urge the lower edge of the frame toward the wall.

31 Claims, 21 Drawing Figures

PICTURE HANGING DEVICE

BACKGROUND OF THE INVENTION

1. Field of the Invention

The invention relates to a picture hanging device comprising cooperable male and female members formed of resilient plastic material and being secured, respectively, to the rear surface of a picture frame and to a wall. The male member is characterized by a fixed or movable spacing portion protruding beyond an integral, vertically depending tongue. The tongue is received within a slot formed on the female member such that the spacing portion contacts an upper guiding portion provided on the female member above the slot. A portion of the tongue remains exposed above the slot when fully inserted therein, that portion being outwardly deflected whereby the lower edge of the picture frame is urged into interfering contact with the wall. The slot is slightly wider than the tongue, allowing the picture frame to be easily adjusted by pivoting of the tongue within the slot 2. Description of the Prior Art Several prior art patents disclose hanging devices wherein a member secured to an object to be hung is provided with a flange or tongue that is received within a cavity formed on a female member secured to a support surface. U.S. Pat. No. 2,402,717 to Winer discloses a panel which may be mounted on a wall by inserting bracket members which are secured to the panel into bracket engaging members which are secured to the wall.

U.S. Pat. No. 3,294,355 to Topf discloses a wall hanger comprising a pair of like members, each of which is provided with a tongue and a slotted portion. The members may be secured, respectively, to an object to be hung and to a wall such that the tongue of one member may be inserted into the slotted portion of the other member. A similar picture hanging bracket is disclosed in U.S. Pat. No. 4,083,525 to Rath wherein a pair of like complementary parts cooperate such that the post of one part is received within a recess formed in the other part.

U.S. Pat. No. 3,622,116 to Fellows discloses a picture hanger comprising a tapered tongue member which is arranged for attachment to the back surface of a picture to be hung. A bracket member defining a tapered socket for the tongue is arranged for attachment to a picture-supporting surface.

U.S. Pat. No. 4,069,998 to Rytting discloses a picture hanger comprising first and second mating components adapted to be secured, respectively, to a picture back and to a wall. The first component includes a hooking bar which may be received within the space formed between the second component and the wall.

It is also known in the prior art to provide a picture hanging device wherein a tongue secured to the back of a frame is adapted to be received within a channel secured to the support surface such that the tongue moves toward the support surface causing the lower edge of the frame to contact thereagainst. See U.S. Pat. No. 2,965,339 to Denton.

None of the prior art devices, however, discloses a picture hanging member that is provided with a novel spacing portion and uniquely configured tongue and slot as utilized by the picture hanging device of the present invention.

SUMMARY OF THE INVENTION

The present invention is directed to a picture hanging device comprising a male member adapted to be secured to the rear surface of a picture frame or other like object and a female member adapted to be secured to a wall or other support surface. The male member includes an upper fastening flange and an integral vertically depending resilient tongue normally lying in the same vertical plane. The tongue is defined by a convex front surface, a flat rear surface, and a rounded lower arcuate edge. The rear surface of the fastening flange is provided with a fixed or movable spacing portion which protrudes beyond the fastening flange and the tongue. The female member includes an upper guiding portion and a lower slot. The slot is defined by a front wall, a rear wall, a pair of side walls, and a concave lower support surface intermediate the front and rear walls. The rear wall is integral with and extends downwardly from the upper guiding portion. The upper guiding portion is provided with an upper guide edge which serves to facilitate entry of the tongue into the slot.

The picture hanging device of the subject invention is utilized when a picture frame having the male member secured thereto is brought into contact with a wall above the female member. The spacing portion on the male member contacts the wall defining the precise distance required to guide the tongue into the slot. Downward movement of the frame parallel to the wall causes the tongue to enter the slot and the spacing portion to pass over the upper guide edge into contact with the upper guiding portion. The lower arcuate edge of the tongue will then bear against the lower concave support surface of the slot. The spacing portion on the male member in contact with the upper guide portion of the female member causes a portion of the tongue remaining exposed above the front wall of the slot to be outwardly deflected, whereby the lower edge of the frame is urged into interfering contact with the wall. The male and female members thus cooperate to create a force at the lower edge of the frame, biasing the frame toward the wall to create a desirable and attractive appearance. The forces created by the interaction of the male and female members, along with frictional contact of the members, hold the picture frame straight and secure against vibration. The width of the slot is slightly greater than the width of the tongue, thus allowing the frame to be easily adjusted by pivoting of the tongue within the slot. The ability to adjust the frame in this manner eliminates the need for transverse movement of the frame and reduces the requirement of accuracy in locating and securing the respective male and female members to the frame and to the wall.

The male member is provided with at least one hole by means of which it may be easily screwed to any type of frame or other like object. Similarly, the female member is provided with at least one hole by means of which it may be easily nailed to any type of wall or other like support surface. Thus, it is apparent that the subject device is simple and effortless to install.

The configuration of the male member spacing portion and tongue, and the female member guiding portion and slot, are such that smooth interaction of the members is assured. The smooth working action between the male and female members greatly facilitates the hanging of, and removal of, the picture frame in relation to the wall. Furthermore, each of the members is formed as an integral unit thereby significantly enhancing simplicity of manufacture and reduction in cost. The male and female members are formed of a resilient plastic material, insuring strength and integrity of the parts.

Accordingly, it is an object of the invention to provide a picture hanging device by means of which a picture frame may be hung upon a wall straight and secure against vibration.

It is an additional object of the invention to provide a picture hanging device whereby the picture frame may be easily adjusted.

It is another object of the invention to provide a picture hanging device that is easy to install.

It is a further object of the invention to provide a picture hanging device by means of which a picture frame may be easily hung upon, and removed from, a wall.

It is an additional object of the invention to provide a picture hanging device that may be utilized on any type of frame and wall.

It is another object of the invention to provide a picture hanging device by means of which the lower portion of the frame is biased toward the wall.

It is a further object of the invention to provide a picture hanging device that reduces the need for accuracy in locating and securing the device to the frame and to the wall.

It is an additional object of the invention to provide a picture hanging device wherein the members interact smoothly.

It is a final object of the invention to provide a picture hanging device that is simple and inexpensive to manufacture.

Additional objects and features of the invention will become apparent from the following detailed description and drawings.

BRIEF DESCRIPTION OF THE DRAWINGS

Further details are explained below with the help of the examples illustrated in the attached drawings in which.

DESCRIPTION OF THE PREFERRED EMBODIMENT

Figure 1:
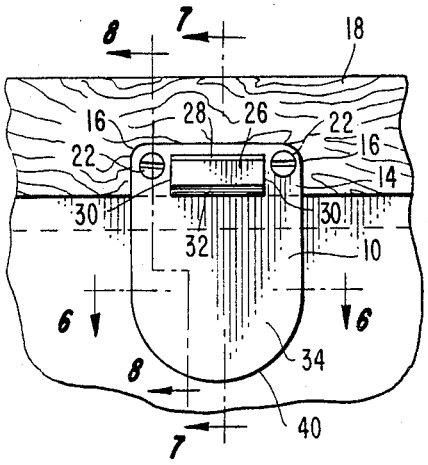
FIG. 1 is a rear view of the male member as it appears when secured to the upper portion of the rear surface of a picture frame.
Figure 4:
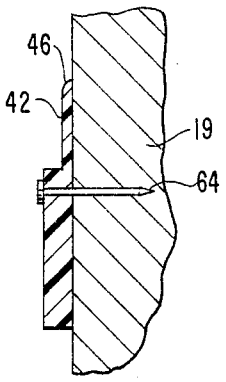
FIG. 4 is a view taken along line 4—4 of FIG. 2 showing a side edge of the female member as it appears when secured to a wall.
Figure 2:
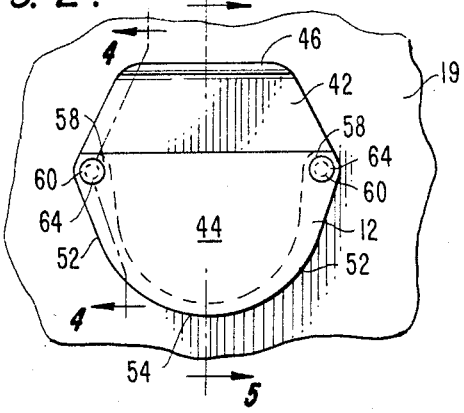
FIG. 2 is a front view of the female member as it appears when secured to a wall.
Figure 7:
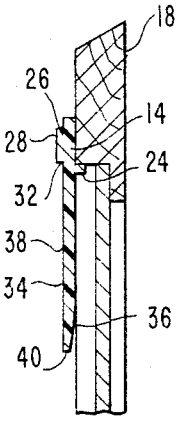
FIG. 7 is a side view of the male member taken along line 7—7 of FIG. 1.
Figure 8:
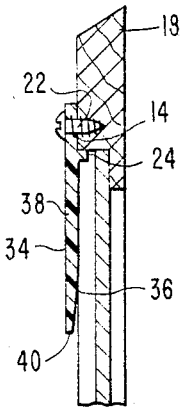
FIG. 8 is a view taken along line 8—8 of FIG. 1 showing a side edge of the male member as it appears when secured to a picture frame.
Figure 6:
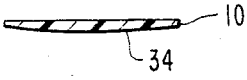
FIG. 6 is a view taken along line 6—6 of FIG. 1 showing the cross-sectional configuration of a portion of the male member.

Referring to the drawings, and in particular to FIGS. 1 and 2, the two-part picture hanging device of the present invention comprises a male member 10 adapted to be rigidly secured to the rear surface of a picture frame 18 or other like object and a female member 12 adapted to be rigidly secured to a wall 19 or other vertical support surface. As is best depicted in FIG. 1, the upper portion of the male member includes a fastening flange 14 which is provided with frame attachment means 16 for securing the male member to the center of the upper portion of the rear of picture frame 18. The frame attachment means may comprise a hole 20 formed on each side of the fastening flange for receipt of screws 22 by means of which the male member is secured to the frame as is shown in FIGS. 1 and 8. The front surface of the fastening flange which faces the rear of frame 18 when the male member is attached thereto is provided with an anchor rib 24 upon which rests the rear surface edge of the frame. FIGS. 7 and 8 illustrate the relationship between the anchor rib and the frame as it appears when the male member is secured to the rear of the frame with the frame rear surface edge resting upon the anchor rib. As is best depicted in FIGS. 1 and 7, the rear surface of the fastening flange facing away from the frame when the male member is attached thereto is provided with an integral spacing portion 26. The spacing portion is defined by an upper smooth edge 28, side edges 30 and a tapered lower guide edge 32.

Referring to FIGS. 1 and 7, the lower portion of male member 10 includes a vertically depending tongue 34 integral with fastening flange 14 and lying in the same vertical plane therewith such that spacing portion 26 protrudes beyond the fastening flange and the tongue. Tongue 34 is provided with a convex front surface 36 facing frame 18 when the male member is attached thereto and a flat rear surface 38 facing away from the frame when the male member is attached thereto. FIG.

6 shows the cross-sectional configuration of the tongue as defined by the convex and flat surfaces. The lower arcuate edge 40 of the tongue is rounded to facilitate cooperation with female member 12.

Figure 5:
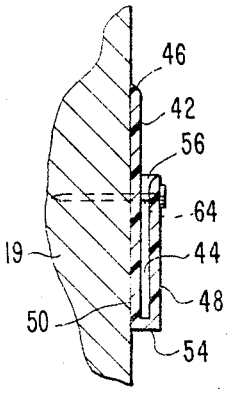
FIG. 5 is a side view of the female member taken along line 5—5 of FIG. 2.

Female member 12, as depicted in FIG. 2, includes an upper guiding portion 42 which extends upwardly from edge 46. Referring to FIGS. 2 and 5, the slot 44 is defined by a front wall 48, a rear wall 50, a pair of side walls 52 and a lower concave support surface 54 intermediate the front and rear walls. Together, the front, rear and side walls define a slot entrance. Referring to FIG. 5, front wall 48 is provided with an upwardly directed rounded lip 56 facing into the slot. Rear wall 50 is integral with upper guiding portion 42 which extends upwardly therefrom. As shown in FIG. 2, each side wall 52 terminates in convex side guides 58 which converge downwardly to meet the upwardly directed slot entrance. Wall attachment means 60 are provided on each side of the slot for securing the female member 12 to the wall 19 or other vertical support surface. As illustrated in FIGS. 2, 3, 4 and 5, the wall attachment means comprise a hole 62 formed on each side of the slot for receiving nails 64 by mean of which the female member is secured to the wall. The setting of nails 64 in relation to holes 62 operates as a unit for maximum strength.

Figure 3:
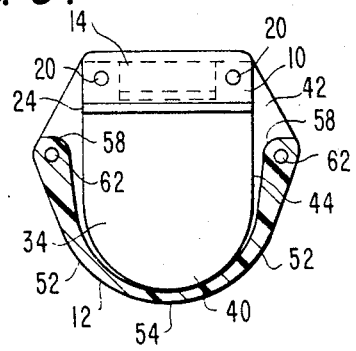
FIG. 3 is a front view of the male member as it appears when fully inserted into the female member.
Figure 9:
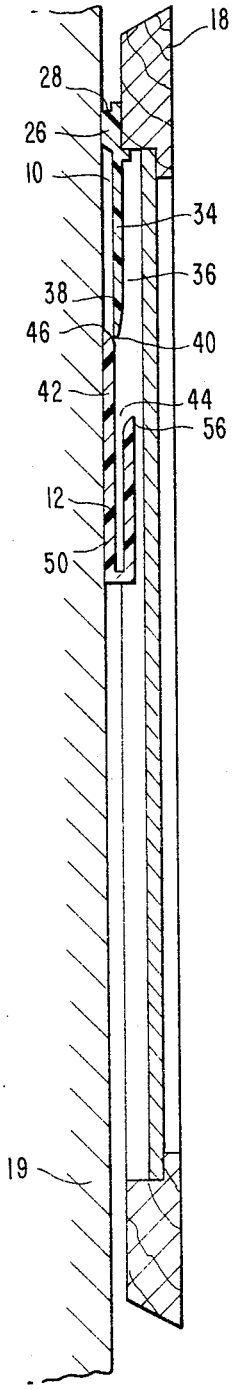
FIGS. 9–11 illustrate the relationship between the male and female members as they cooperate sequentially during the hanging of a picture frame.

The width of slot 44 is defined by the distance between side walls 52. The depth of the slot is measured by the distance from the rounded lip 56 to the lower concave support surface 54. The depth and width of the slot are such that it envelops tongue 34 when inserted therein as shown in FIG. 3, with the width of the slot being slightly greater than the width of the tongue. When fully inserted, the lower arcuate edge 40 of the tongue bears against the lower concave support surface 54 of the slot and a portion of the tongue remains exposed above the front wall 48 of the slot as shown in FIGS. 3 and 9. The thickness of the slot, as can be seen in FIG. 5, is determined by the distance between the front and rear walls 48 and 50, respectively. This dimension is such that the slot is slightly thinner than the thickness of tongue 34.

Figure 10:
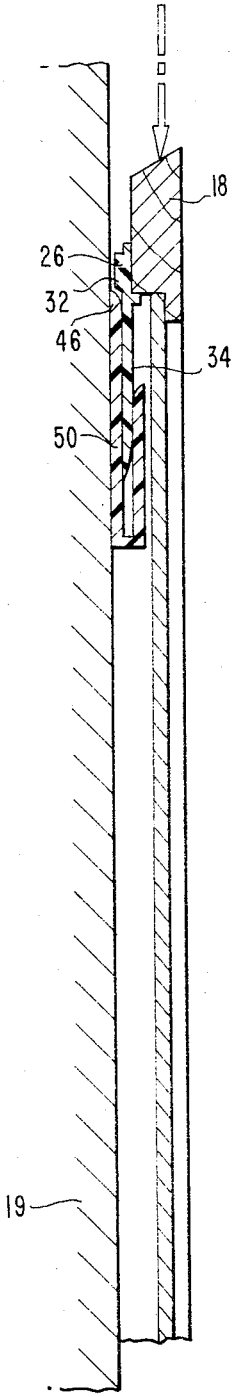
Figure 11:
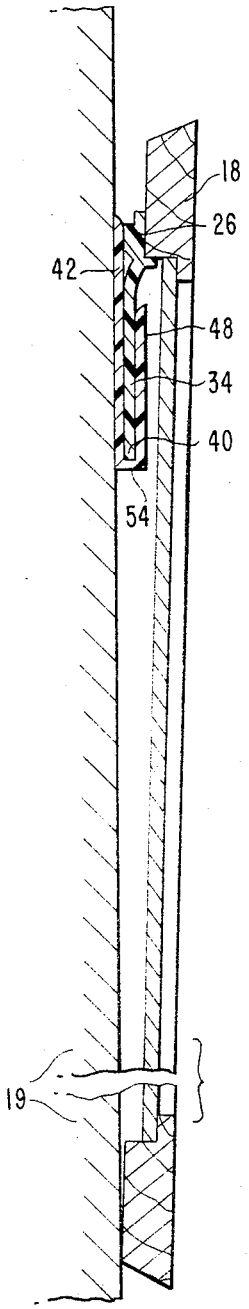

FIGS. 9–11 illustrate the relationship between the male and female members as they cooperate during the hanging of frame 18 upon wall 19. FIG. 9 depicts the male and female members 10,12, secured, respectively, to frame 18 and to wall 19. The frame, with the male member attached thereto, is then manually urged toward the wall above the female member. Only the exposed upper smooth edge 28 of spacing portion 26 need lightly touch the wall. The spacing portion in contact with the wall creates the exact distance required for tongue 34 to freely enter slot 44 when the picture frame is manually lowered parallel to the wall. Tongue 34 contacts the female member at either the rounded upper guide edge 46, the convex side guides 58, or the rounded lip 56 of the front wall of the slot. Lip 56 of the slot and the rounded lower arcuate edge 40 of the tongue serve to facilitate insertion of the tongue into the slot. Smooth interaction of the male and female members is further assured by the convex front surface 36 and flat rear surface 38 of the tongue, making it easy to insert the tongue into and remove it from the slot.

FIG. 10 depicts the tongue 34 as it is inserted into the slot 44 by continued downward movement of the frame parallel to the wall. Again, spacing portion 26 of the male member in contact with the wall 19 serves to create the distance necessary to guide the tongue into the slot. The tapered lower guide edge 32 of the spacing portion is shown contacting the rounded upper guide edge 46 of the female member. The tapered and rounded surfaces of these respective parts allow the tongue to freely progress into the slot.

In FIG. 11, the male member is shown as it appears when fully inserted into the slot with the lower arcuate edge 40 of tongue 34 bearing against the lower concave support surface 54 of slot 44. At this critical point, the spacing portion has passed over the rounded upper guide edge 46 and into contact with the upper guiding portion 42. Spacing portion 26 in contact with upper guiding portion 42 works as a unit to force the upper portion of the frame outwardly away from the wall. Since the tongue 34 is simultaneously held securely within slot 44, the lower edge of the frame is forced inwardly towards the wall. A frictional force between the frame and the wall is created, thereby holding the frame securely in place. Thus, a portion of the tongue remaining exposed above the front wall 48 of the slot is resiliently deflected from the configuration shown in FIGS. 9 and 10 outwardly toward the frame with the lower edge of the frame being biased toward the wall. The forces which contribute to this condition include the force toward the frame resulting from spacing portion 26 bearing against guiding portion 42, the force toward the wall exerted by the front wall 48 of the slot on tongue 34, and the force toward the wall exerted by the front wall 48 of the slot on the convex front surface 36 of the tongue 34. Together, these forces result in a force toward the wall at the lower frame edge, which urges the lower edge of the frame into interfering contact with the wall, thus creating a desirable and attractive appearance. These forces, along with frictional hold of the rear wall 50 of the slot on the flat rear surface 38 of the tongue and frictional hold of the guiding portion 42 on spacing portion 26, serve to hold the frame in its desired position secure against vibration.

The frame may be easily adjusted by pivoting of the tongue either right or left within the slot on the point of contact of the lower arcuate edge of the tongue and the lower concave support surface of the slot. This pivotal movement is possible without transverse movement of the frame due to the oversizing of the width of the slot in relation to the width of the tongue. In addition, the height and the width of the upper guiding portion are such as to permit free rotation of the frame in both directions. The freedom of movement allows levelness of the female member, when secured to a wall, to vary to some degree since compensation is possible. The setting of the male member on a frame is governed by the configuration of the fastening flange and by the center of the upper portion of the frame.

Figure 12:
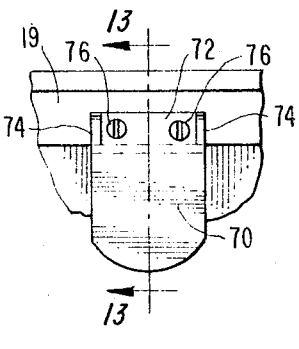
FIG. 12 is a rear view of a first alternative embodiment for the male member of the subject picture hanging device as it appears when secured to the upper portion of the rear surface of a picture frame.
Figure 13:
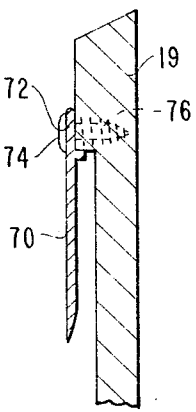
FIG. 13 is a side view of the male member of FIG. 12 taken along line 13—13.

A first alternative embodiment for the male member of the subject picture hanging device is illustrated in FIGS. 12 and 13. As depicted therein, the male member 70 is provided with an upper fastening flange 72 that has a spacing portion in the form of an integral protrusion 74 formed on its rear surface at each side edge. Male member 70 is secured to the rear of a picture frame 19 by means of two screws 76 located on either side of the fastening flange proximate the spacing portions. The dual spacing portions enable the picture hanging device to compensate for irregularities frequently encountered in wood frames which result in the failure of one of the lower corners of the frame to be biased toward the wall. Should one corner of the picture frame fail to contact the wall, the condition can be corrected by unscrewing the screw located on the fastening flange at the side opposite to the unbiased corner. The screw may be unscrewed as necessary to dispose that side of the fastening flange and its corresponding spacing portion further away from the frame such that the opposite corner of the frame sits evenly against the wall.

Figure 14:
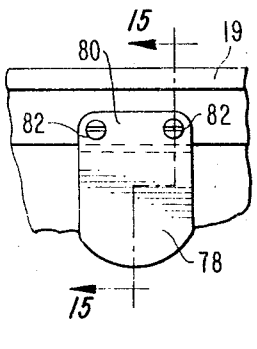
FIG. 14 is a rear view of a second alternative embodiment for the male member of the subject picture hanging device as it appears when secured to the upper portion of the rear surface of a picture frame.
Figure 15:
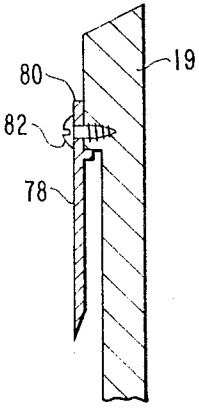
FIG. 15 is a side view of the male member of FIG. 14 taken along line 15—15.

A second alternative embodiment for the male member of the subject picture hanging device is shown in FIGS. 14 and 15. The male member 78 so illustrated is provided with a fastening flange 80 and a movable spacing portion in the form of two round head screws 82 located proximate each of the side edges of the fastening flange. The screws 82 serve to adjust the frame 19 as previously discussed in connection with the male member of FIGS. 12 and 13.

Figure 16:
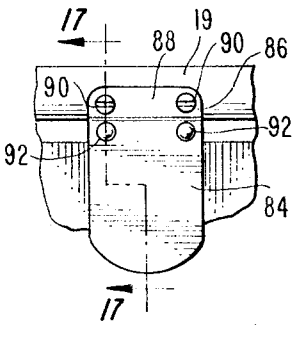
FIG. 16 is a rear view of a third alternative embodiment for the male member of the subject picture hanging device as it appears when secured to the upper portion of the rear surface of a picture frame.
Figure 17:
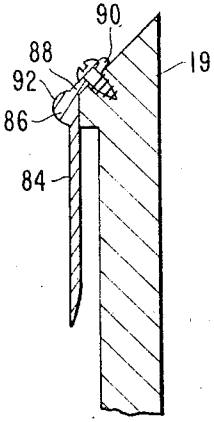
FIG. 17 is a side view of the male member of FIG. 16 taken along line 17—17.

FIGS. 16 and 17 present a third alternative embodiment for the male member of the subject picture hanging device. Male member 84 is provided with a fastening flange 86 that terminates in an upper angular portion 88 conforming to the surface of picture frame 19. The angular portion is provided with screws 90 by means of which the male member is secured to the rear surface of the frame. Two fixed humps 92 are formed on either side of the vertical lower portion of the fastening flange beneath the angular portion 88. Alternatively, fixed humps 92 may be replaced by round head screws as was described in connection with FIGS. 14 and 15.

Figure 18:
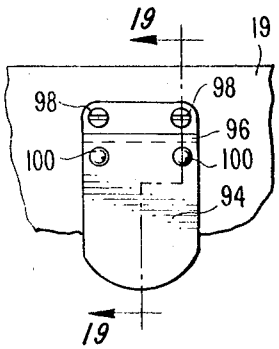
FIG. 18 is a rear view of a fourth alternative embodiment for the male member of the subject picture hanging device as it appear when secured to the upper portion of the rear surface of a picture frame.
Figure 19:
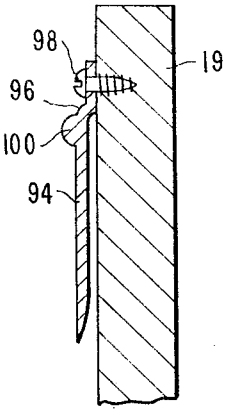
FIG. 19 is a side view of the male member of FIG. 18 taken along line 19—19.

A fourth alternative embodiment for the male member of the subject invention is illustrated in FIGS. 18 and 19. The male member 94 is provided with a fastening flange 96 having two screws 98 for securing the male member to the rear of a picture frame 19. The lower portion of the fastening flange is offset slightly away from the frame and is provided with a fixed hump 100 proximate each side edge. Fixed humps 100 may, alternatively, be replaced by round head screws as was described in connection with FIGS. 14 and 15.

Figure 20:
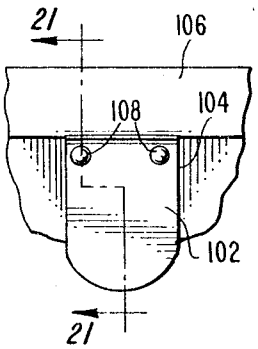
FIG. 20 is a rear view of a fifth alternative embodiment for the male member of the subject picture hanging device as it appears when secured to the upper portion of the rear surface of a picture frame.
Figure 21:
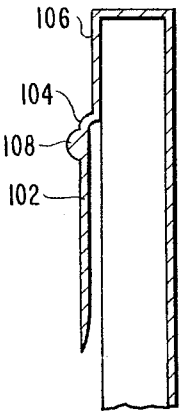
FIG. 21 is a side view of the male member of FIG. 20 taken along line 21—21.

A fifth and final embodiment for the male member of the subject invention is shown in FIGS. 20 and 21. Male member 102 is provided with a fastening flange 104, the upper portion of which is molded integral with the surface of plastic frame 106. The fastening flange is offset slightly from the frame and includes a fixed hump 108 proximate each of its side edges.

Both the male and female members are of unitary construction, being formed of resilient plastic or metal material. The simplicity of the parts results in ease of manufacture and reduction in cost while maintaining strengt and integrity.

The configuration of the male member tongue and spacing portion and the female member guiding portion and slot insure smooth interaction of the members. Hence, the hanging of a picture frame onto a wall, and its removal therefrom, is virtually effortless when practiced according to the instant invention.

Various changes in the details, materials, steps and arrangement of parts which have been described and illustrated herein may be made without departing from the principle and scope of the invention as expressed in the appended claims.

What is claimed is:

1. A picture hanging device comprising a male member adapted to be rigidly secured to the rear surface of a picture frame or other like object and a female member adapted to be rigidly secured to a wall or other like support surface, said male member including a fastening flange and a resilient vertically depending tongue normally lying in the same vertical plane, said male member being provided with a spacing portion, said spacing portion protruding outwardly beyond said tongue and said fastening flange, said female member including a guiding portion and a slot, said guiding portion being adapted to contact said spacing portion when said tongue is fully inserted within said slot, a portion of said tongue being exposed above said slot when said tongue is fully inserted therein, said exposed portion being outwardly deflected whereby the lower edge of said frame or other like object is biased toward said wall or other like support surface.

2. The picture hanging device of claim 1 wherein said spacing portion is defined by an upper smooth edge, a pair of side edges and a tapered lower guide edge, said spacing portion being provided on the rear surface of said fastening flange facing away from said frame or other like object when said male member is secured thereto, said spacing portion is fixed, said tongue is provided with a lower rounded arcuate edge, said tongue being further provided with a convex front surface facing said frame or other like object when said male member is secured thereto, and a flat rear surface facing away from said frame or other like object when said male member is secured thereto, said fastening flange and said tongue being integral.

3. The picture hanging device of claim 1 wherein said guiding portion terminates in a rounded upper guide edge, said slot is defined by a front wall, a rear wall, a pair of side walls, and a lower concave support surface intermediate said front and rear walls, said front wall being provided with an upwardly directed rounded lip facing into said slot, said rear wall being integral with and extending downwardly from said guiding portion, said side walls each terminating in convex side guides.

4. The picture hanging device of claim 1 wherein said tongue and said fastening flange normally lie in the same vertical plane, said spacing portion protrudes beyond said fastening flange and said tongue, said spacing portion includes protrusions located proximate each of the side edges of said male member.

5. The picture hanging device of claim 4 wherein said protrusions are fixed.

6. The picture hanging device of claim 4 wherein said protrusions are movable.

7. The picture hanging device of claim 1 wherein said fastening flange includes a vertical and an angular portion, said vertical portion and said tonque normally lying in the same vertical plane, said spacing portion protrudes beyond said fastening flange, said spacing portion includes a protrusion located proximate each of the side edges of said male member.

8. The picture hanging device of claim 7 wherein said protrusions are fixed.

9. The picture hanging device of claim 7 wherein said protrusions are movable.

10. The picture hanging device of claim 1 wherein said fastening flange includes an upper portion and a lower portion, said lower portion is offset from said upper portion, said lower portion and said tongue normally lie in the same vertical plane, said spacing portion protrudes beyond said fastening flange, said spacing portion includes a protrusion located proximate each of the side edges of said male member.

11. The picture hanging device of claim 10 wherein said protrusions are fixed.

12. The picture hanging device of claim 10 wherein said protrusions are movable.

13. The picture hanging device of claim 4 wherein said male member is formed integral with said picture frame and is offset therefrom.

14. The picture hanging device of claim 13 wherein said protrusions are fixed.

15. The picture hanging device of claim 13 wherein said protrusions are movable.

16. The picture hanging device of claim 1 wherein said slot is wider than and thinner than said tongue.

17. The picture hanging device of claim 1 wherein the front surface of said fastening flange facing said frame or other like object when said male member is secured thereto is provided with an anchor rib.

18. The picture hanging device of claim 1 wherein said male and female members are formed of a resilient plastic or metal material.

19. The picture hanging device of claim 1 further comprising means provided on said fastening flange for securing said male member to said frame or other like object and means provided on each side of said slot for securing said female member to said wall or other like support surface.

20. A picture hanging device comprising a male member adapted to be rigidly secured to the rear surface of a picture frame or other like object and a female member adapted to be rigidly secured to a wall or other like support surface, the upper portion of said male member including a fastening flange, said fastening flange being provided with means for securing said male member to said frame or other like object, said fastening flange being further provided with a spacing portion on its rear surface facing away from said frame or other like object when said male member is secured thereto, the lower portion of said male member including a resilient vertically depending tongue, said tongue being integral with said fastening flange and normally lying in the same vertical plane, said spacing portion protruding outwardly beyond said fastening flange and said tongue, the upper portion of said female member including a guiding portion, the lower portion of said female member including a slot, said slot being defined by a front wall, a rear wall, a pair of side walls, and a lower support surface intermediate said front and rear walls, said rear wall being integral with and extending downwardly from said guiding portion, said guiding portion being adapted to contact said spacing portion when said tongue is fully inserted within said slot, said slot being provided on each side with means for securing said female member to said wall or other support surface, a portion of said tongue being exposed above said slot when said tongue is fully inserted therein, said exposed portion being outwardly deflected whereby the lower edge of said frame or other like object is biased toward said wall or other like support surface.

21. The picture hanging device of claim 20 wherein said spacing portion is defined by an upper smooth edge, a pair of side edges and a tapered lower guide edge, said tongue is provided with a lower rounded arcuate edge, said tongue being further provided with a convex front surface facing said frame or other like object when said male member is secured thereto and a flat rear surface facing away from said frame or other like object when said male member is secured thereto.

22. The picture hanging device of claim 20 wherein said guiding portion terminates in a rounded upper guide edge, said front wall of said slot is provided with an upwardly directed rounded lip facing into said slot, said lower support surface of said slot is concave, said side walls of said slot each terminate in convex side guides.

23. The picture hanging device of claim 20 wherein said slot is wider than and thinner than said tongue.

24. The picture hanging device of claim 20 wherein the front surface of said fastening flange facing said frame or other like object when said male member is secured thereto is provided with an anchor rib.

25. The picture hanging device of claim 20 wherein said male and female members are formed of a resilient plastic material.

26. The picture hanging device of claim 20 wherein said means for securing said male member to said frame or other like object comprises at least one hole on said fastening flange for receiving a screw, said means for securing said female member to said wall or other like support surface comprises at least one hole on each side of said slot for receiving a nail.

27. A picture hanging device comprising a male member adapted to be rigidly secured to the rear surface of a picture frame or other like object and a female member adapted to be rigidly secured to a wall or other like support surface, the upper portion of said male member including a fastening flange, said fastening flange being provided with means for securing said male member to said frame or other like object, said fastening flange being provided with an anchor rib on its front surface facing said frame or other like object when said male member is secured thereto, said fastening flange being further provided with a spacing portion on its rear surface facing away from said frame or other like object when said male member is secured thereto, said spacing portion being defined by an upper smooth edge, a pair of side edges and a tapered lower guide edge, the lower portion of said male member including a resilient vertically depending tongue, said tongue being integral with said fastening flange and normally lying in the same vertical plane, said tongue being provided with a lower rounded arcuate edge, said tongue being further provided with a convex front surface facing said frame or other like object when said male member is secured thereto, and a flat rear surface facing away from said frame or other like object when said male member is secured thereto, said spacing portion protruding outwardly beyond said fastening flange and said tongue, the upper portion of said female member including a guiding portion, said guiding portion terminating in a rounded upper guide edge, the lower portion of said female member including a slot, said slot being defined by a front wall, a rear wall, a pair of side walls, and a lower concave support surface intermediate said front and rear walls, said front wall being provided with an upwardly directed rounded lip facing into said slot, said rear wall being integral with and extending downwardly from said guiding portion, said side walls each terminating in convex side guides, said slot being provided on each side with means for securing said female member to said wall or other like support surface, said guiding portion being adapted to contact said spacing portion when said tongue is fully inserted within said slot, a portion of said tongue being exposed above said slot when said tongue is fully inserted therein, said exposed portion being outwardly deflected whereby the lower edge of said frame or other like object is biased toward said wall or other like support surface.

28. The picture hanging device of claim 27 wherein said slot is slightly wider than and thinner than said tongue.

29. The picture hanging device of claim 27 wherein said male and female members are formed of a resilient plastic material.

30. The picture hanging device of claim 27 wherein said means for securing said male member to said frame or other like object comprises at least one hole on said fastening flange for receiving a screw, said means for securing said female member to said wall or other like support surface comprises at least one hole on each side of said slot for receiving a nail.

31. The method of using a picture hanging device wherein a male member is rigidly secured to the rear surface of a picture frame or other like object and a female member is rigidly secured to a wall or other like support surface, said male member having a fastening flange and a depending tongue normally lying in the same vertical plane, said female member being provided with a spacing portion protruding beyond said fastening flange and said tongue, said female member having a guiding portion and a slot, comprising the steps of locating said picture frame or other like object proximate said wall or other like support surface whereby said spacing portion is brought into interfering contact with said wall or other like support surface above said female member, lowering said picture frame or other like object whereby said tongue contacts said guiding portion of said female member, inserting said tongue into said slot such that said spacing portion contacts said guiding portion whereby a portion of said tongue exposed above said slot is outwardly deflected such that the lower edge of said picture frame or other like object is urged toward said wall or other support surface, and adjusting said frame or other like object by pivoting said tongue within said slot.

* * * * *